US006500021B2

(12) United States Patent
Wilmes et al.

(10) Patent No.: US 6,500,021 B2
(45) Date of Patent: Dec. 31, 2002

(54) TERMINAL BLOCK WITH DISCONNECT CONTACTS AND CONTACT OPERATING MEANS

(75) Inventors: Manfred Wilmes, Detmold (DE); Reinhard Nolting, Detmold (DE); Torsten Diekmann, Bielefeld (DE)

(73) Assignee: Weidmueller Interface GmbH & Co., Detmold (DE)

( * ) Notice: Subject to any disclaimer, the term of this patent is extended or adjusted under 35 U.S.C. 154(b) by 0 days.

(21) Appl. No.: 09/950,602

(22) Filed: Sep. 13, 2001

(65) Prior Publication Data

US 2002/0037670 A1 Mar. 28, 2002

(30) Foreign Application Priority Data

| | | |
|---|---|---|
| Sep. 25, 2000 | (DE) | 200 16 653 U |
| Jan. 20, 2001 | (DE) | 201 01 034 U |
| Apr. 14, 2001 | (DE) | 201 06 525 U |

(51) Int. Cl.[7] ..... H01R 11/20
(52) U.S. Cl. ..... 439/409; 439/395
(58) Field of Search ..... 439/409, 417, 439/395, 716, 709

(56) References Cited

U.S. PATENT DOCUMENTS

| | | | | |
|---|---|---|---|---|
| 4,379,605 A | * | 4/1983 | Hoffman | 439/107 |
| 4,466,682 A | * | 8/1984 | Jusseau et al. | 439/391 |
| 4,729,738 A | * | 3/1988 | Heng et al. | 439/395 |
| 6,027,361 A | * | 2/2000 | Burmeister et al. | 439/395 |
| 6,120,315 A | * | 9/2000 | Gaertner et al. | 439/395 |

FOREIGN PATENT DOCUMENTS

| | | |
|---|---|---|
| DE | 39 38 351 A1 | 6/1990 |
| DE | 44 37 022 C1 | 2/1996 |
| DE | 196 27 209 C1 | 10/1997 |
| DE | 197 49 622 C1 | 2/1999 |
| DE | 197 32 182 C1 | 3/1999 |
| DE | 299 08 384 U1 | 9/1999 |
| DE | 198 35 459 A1 | 2/2000 |
| EP | 0 936 697 A1 | 11/1998 |

* cited by examiner

*Primary Examiner*—Gary Paumen
*Assistant Examiner*—James R. Harvey
(74) *Attorney, Agent, or Firm*—Lawrence E. Laubscher, Sr.

(57) ABSTRACT

A terminal block assembly includes an actuator member that is displaceable relative to a terminal block housing to transport an insulated conductor toward the insulating penetrating knife edges of a stationary electrical contact mounted within the housing, characterized by the provision of a guide pin and guide groove arrangement for guiding the actuator member during the displacement thereof relative to the housing.

14 Claims, 11 Drawing Sheets

42'
36
15
4a
22
W
26
14
32
42
4
14a
44
28
30
M

TERMINAL BLOCK WITH DISCONNECT CONTACTS AND CONTACT OPERATING MEANS

REFERENCE TO RELATED APPLICATION

This application is a companion application to the U.S. application of Peter Stuckmann, et al., Ser. No. 09/950,603 filed Sep. 13, 2001, entitled "Terminal Block with Disconnect Contact and Terminal Arrangement".

SPECIFICATION

Field of the Invention

A terminal block assembly includes an actuator member that is displaceable relative to a terminal block housing to transport an insulated conductor into engagement with the knife edges of a stationary electrical contact on the terminal block, thereby to effect penetration of the insulation and electrical connection between the conductor and the stationary contact, characterized by the provision of guide means for guiding the actuator member during the movement thereof relative to said terminal block housing.

BACKGROUND OF THE INVENTION

Brief Description of the Prior Art

A terminal block with a connecting device that penetrates the insulation layer of an insulated conductor is disclosed in the German published application No. 196 27 209. The connecting device illustrated in this publication features contact cutters with cutting edges that widen to form contacting surfaces. The contacting surfaces facilitate a larger-surface contacting of the line lead(s) of the connected electrical conductor than do the actual contact cutters used in severing the conductor, which essentially touch the conductor in a "linear fashion."

The solution offered in German Patent No. DE 197 32 182 C1 proved effective in order further to support the outside resiliency of the connecting devices. This publication discloses, among other things, a cutting terminal contact with a contact spring having two elastic contact legs that define a contact slit where a U-shaped support spring is provided that has plate-shaped spring legs. The U-shaped support spring or overspring is designed as a part that is separated from the actual contact or the resilient contact. The plate-shaped spring legs essentially are aligned normal to the cutting terminal or the contacting areas of the contact legs and encompass the latter along the contact slit over a predetermined width.

European Patent No. EP 0 936 697 A1 discloses a typical terminal block. The contact springs are made each time on both ends of a bus bar, which is so aligned in the housing made of insulation material that the insertion openings of the two resilient stationary contacts point away f rom each other, that is to say, a conductor is introduced into the resilient contact from the outside with relation to the mounting rail. To make the actual introduction of the conductors into the contact springs easier, there are provided contact activation pieces that are arranged on the top of the housing that is made of insulation material. The contact activation pieces are made in the form of a slide and are inserted in the housing made of insulation material from the outside upon first assembly. Each has a conductor introduction opening, and under an essentially U-shaped recess in the foot area, it has lateral catch surfaces as well as a deep stop for the conductor.

Dovetail-like guides are made in the upper opening area of the housing made of insulation material; the contact activation piece is guided in a movable manner on these guides with bilaterally corresponding dovetail grooves. The contact activation piece can be shifted by means of a screwdriver between a conductor insertion position and a contacting position and these two positions are defined by a catch position.

This terminal block and its connecting devices generally have proven to be effective. For various practical purposes, however, it is desirable to so develop the design structure of the terminal block and the connecting device that one can make terminal blocks with particularly small dimensions. In particular, the dimensions of the metal subassembly of the connecting device should be made as compact as possible, and the forces that are introduced into the insulation material housing of the terminal block should also be kept as small as possible. The task of the present invention is to solve this problem.

SUMMARY OF THE INVENTION

Accordingly, a primary object of the present invention is to provide a terminal block assembly including an actuator member that carries an insulated conductor between disengaged and engaged positions relative to a stationary contact supported within a chamber contained in the terminal block, characterized in that the actuator member is guided by guide pin and groove means for pivotal or linear movement relative to the terminal block housing. The guide pins extend laterally from the actuator for engagement with the guide grooves contained in opposing walls of the terminal block. Both the actuator member and the terminal block are formed from electrically insulating synthetic plastic material. The guide means prevent jamming of the actuator relative to the terminal block, and the length of the guide grooves may be reduced as compared with a pure shifting of the actuator member without any guide means.

Another object of the invention is to arrange the stationary resilient contacts on inwardly directed end portions of the bus bar, with the respective actuator members being arranged between the stationary contacts. In this manner, only pressure forces act on the actuator members during the displacement thereof between their engaged and disengaged portions relative to the stationary contacts.

BRIEF DESCRIPTION OF THE DRAWINGS

Other objects and advantages of the invention will become apparent from a study of the following specification when viewed in the light of the accompanying drawings, in which.

DETAILED DESCRIPTION

Figure 1A:
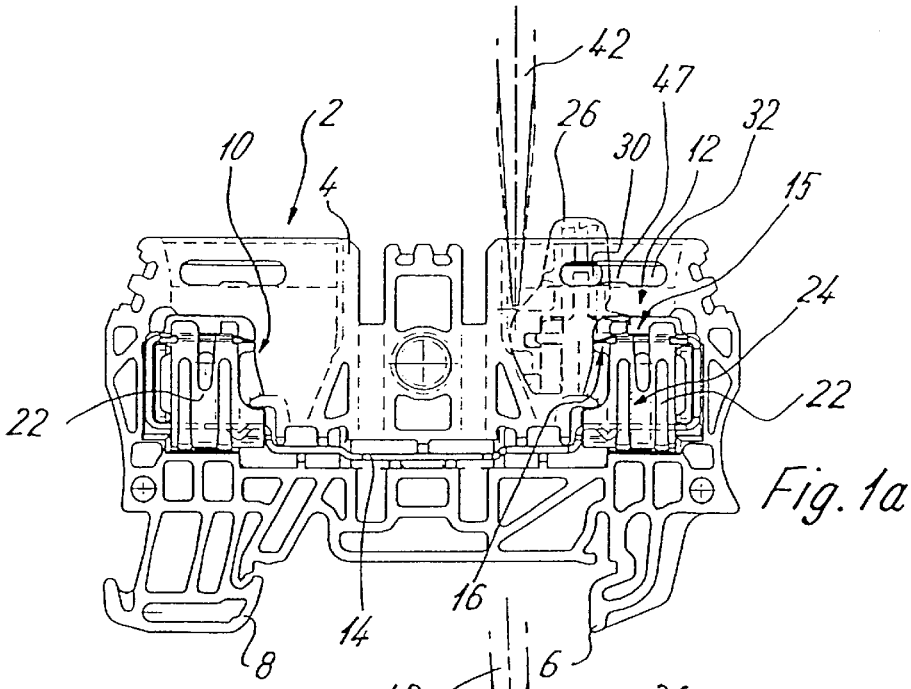
FIGS. 1*a*–1*e* are side elevational views of the terminal block illustrating the manner of operation of the actuator member from the disengaged position toward the engaged position, thereby to displace an insulated conductor toward the knife edges of the stationary resilient contact.
Figure 1B:
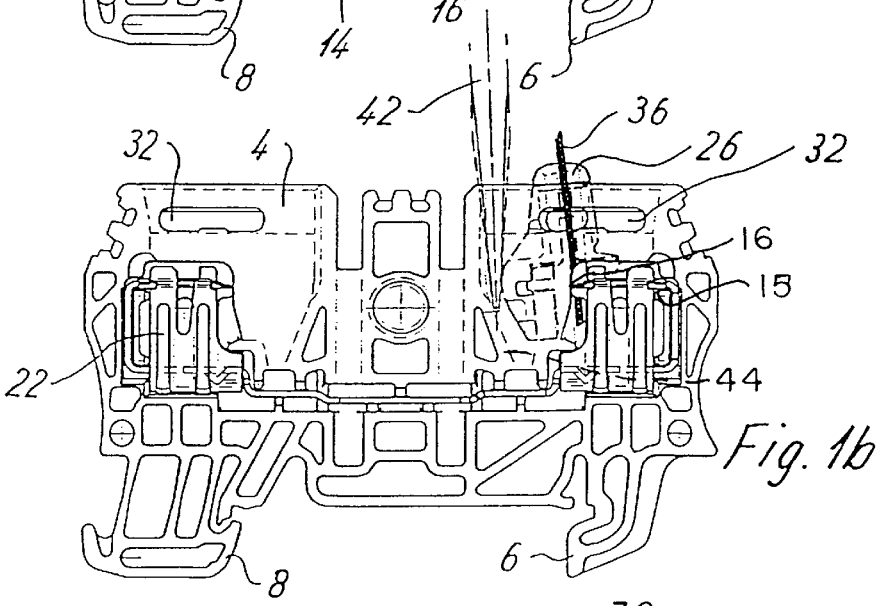
Figure 1C:
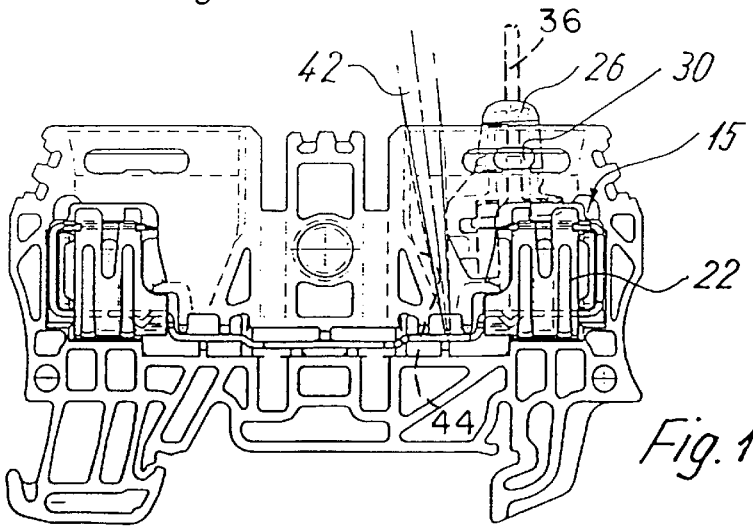
Figure 1D:
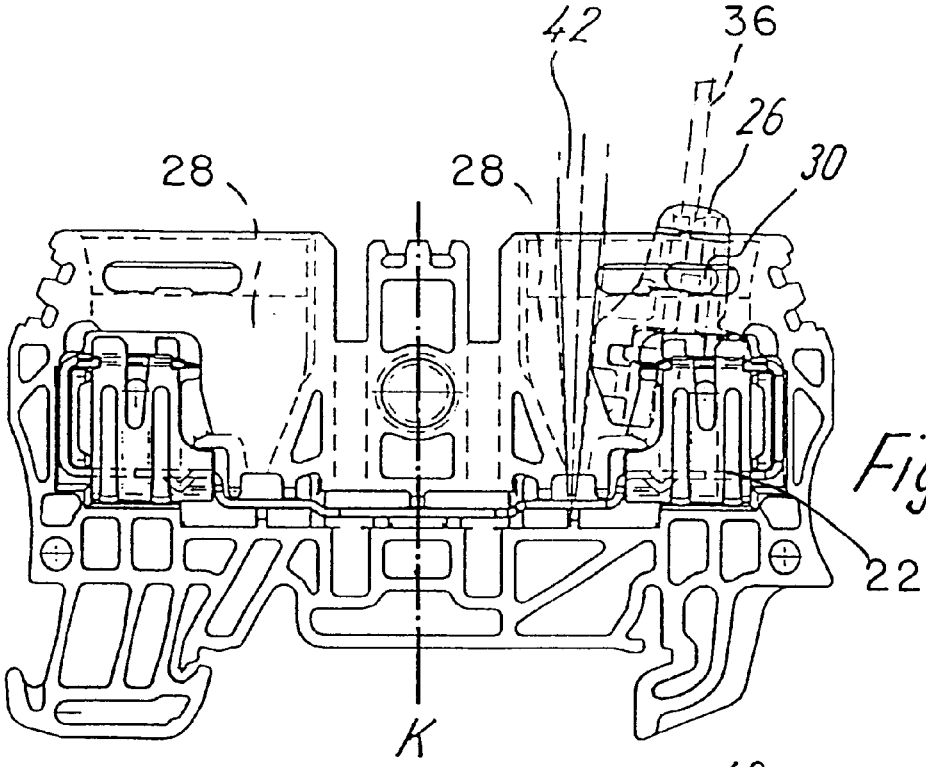
Figure 1E:
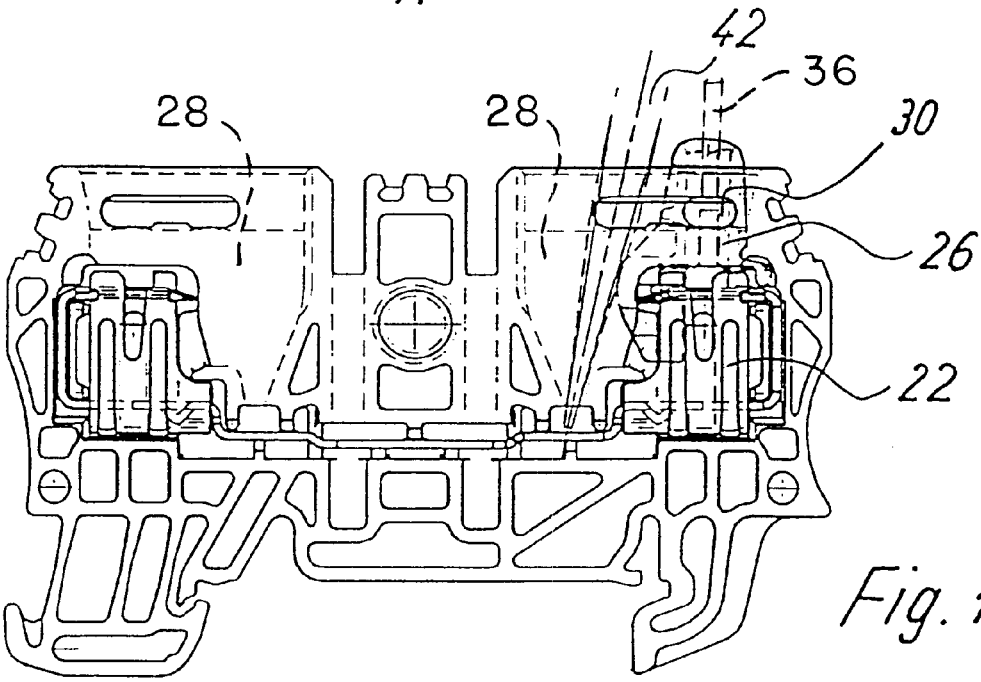

Referring first more particularly to FIGS. 1*a*–1*e*, the terminal block assembly 2 of the present invention includes a terminal block housing 4 that is formed of synthetic plastic insulating material and within which is mounted a bus bar 14 that extends between electrical connections 10 and 12 at opposite ends of the terminal block. The bus bar 14 carries a pair of inwardly directed opposed stationary resilient contacts 15 the adjacent extremities of which are provided with knife edges 16 that are operable to penetrate the insulation layer of electrical conductors 36 that are associated with the connector means 10 and 12, respectively. A pair if U-shaped resilient support springs 22 are provided at each of the connector means 10 and 12 for laterally supporting the stationary contacts 15 relative to the terminal block housing 4, respectively. Moveably mounted within chambers 28 (FIG. 5) contained in opposite ends of the housing 4 are a pair of actuator members 26. When the actuator member 26 is in the disengaged position of FIG. 1*a*, an insulated conductor 36 may be longitudinally inserted within a bore 34 (FIG. 3*c*) that extends vertically through the actuator member 26. When an operating tool 42 (such as the tip of a screwdriver) is inserted into chamber 28 on the left hand side of the actuator member 26, the actuator member is pivoted in the clockwise direction to displace the conductor 36 toward the knife edges 16 of the stationary spring contact 15. As the tool 42 is progressively inserted within the opening contained in the housing 4, the tip of the tool engages an inclined downwardly directed internal surface 44 of the housing chamber 28, and progressively pivots the actuator member 26 to the right to the position of FIG. 1*c*, wherein the knife edges 16 penetrate the insulating layer of the conductor 36. Upon further insertion of the operating tool 42, the tip is supported adjacent the bus bar 14 as shown in FIG. 1*c*, and further displacement of the tool to the right causes pivotal movement of the operating member 26 to the right to the fully engaged position of FIG. 1*e*. During this movement of the actuator 26 and the conductor 36 relative to the stationary contact 15, the stationary contact is laterally supported by the upper extremities of the legs of the U-shaped support spring 22.

Figure 2A:
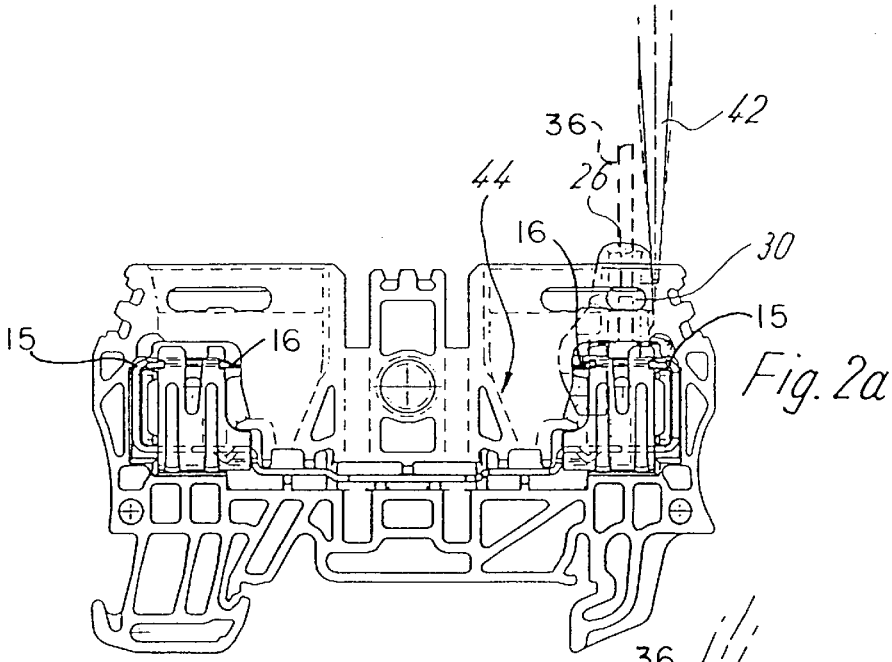
FIGS. 2*a*–2*c* illustrate the displacement of the actuator member from the engaged position toward the disengaged condition.
Figure 2B:
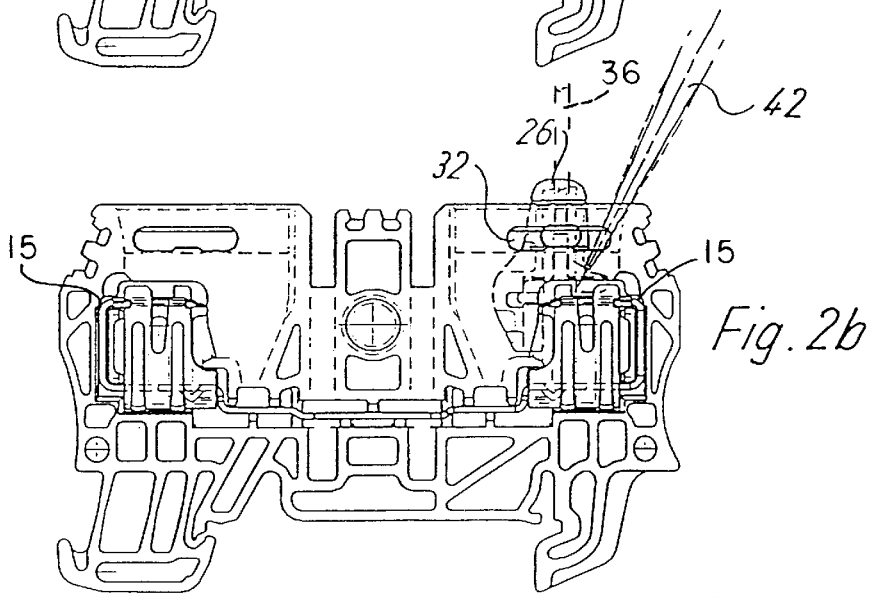
Figure 2C:
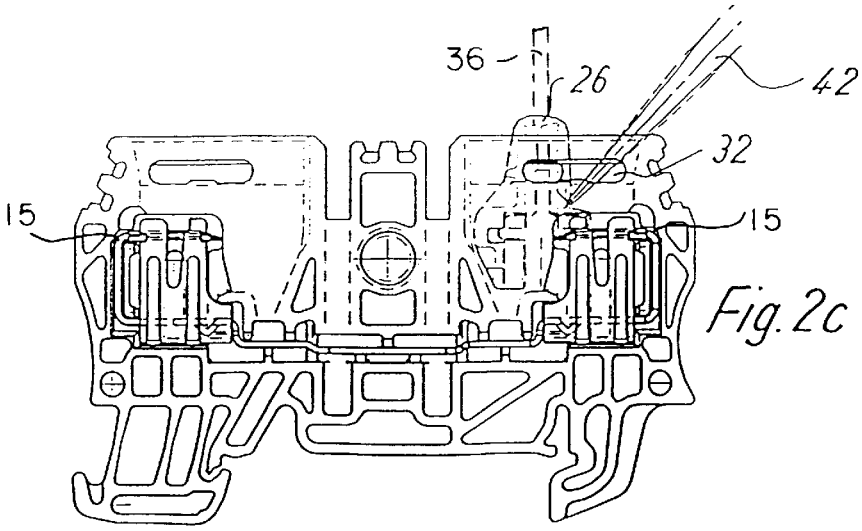

Similarly, as shown in FIGS. 2*a*–2*c*, after the tip of the operating tool 42 (such as a screwdriver) is inserted to the right of the actuator member 26 in the fully engaged position of FIG. 2*a*, the operating tool is pivoted to the right as shown in FIG. 2*b*, thereby to displace the actuating member to the left together with the conductor 36 carried thereby, and thus effect disengagement of the conductor from the stationary resilient contact 15. When the actuator member 26 is completely pivoted to the left to the disengaged position of FIG. 2*c*, the conductor 36 is released from the stationary contact 15 for vertical removal from the actuating member 26.

Figure 3A:
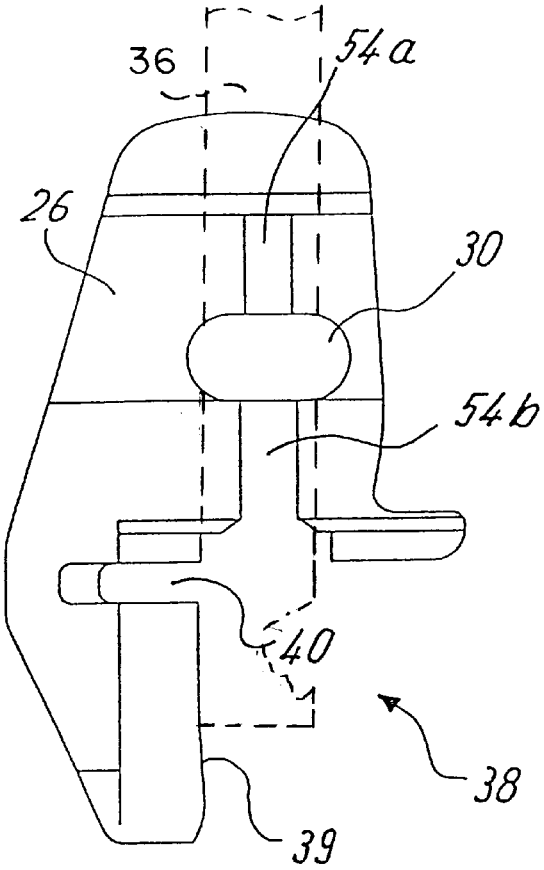
FIGS. 3*a*–3*c* are side elevation, end, and top views, respectively, of the actuator member of FIG. 1.
Figure 3B:
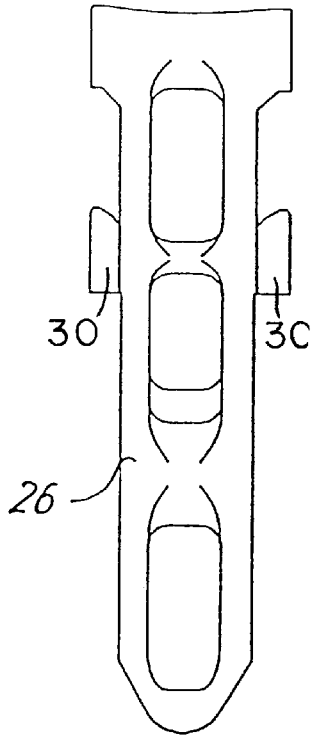
Figure 3C:
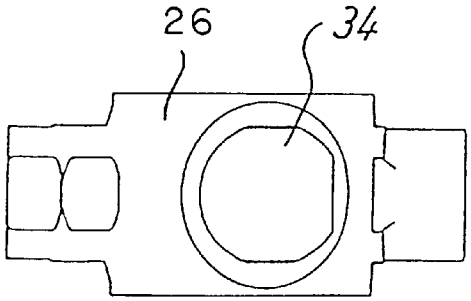

Referring now to FIGS. 3*a*–3*c*, the actuator member 26 contains a vertical bore 34 for receiving the insulated conductor 36, as well as lateral slots 54*a* and 54*b* for receiving the insulated outer surface of the conductor 36. The lower end of the actuator member 26 contains a recess 38 that defines the conductor support wall 39 for laterally supporting the lower end of the insulated conductor 36. In accordance with a characterizing feature of the present invention guide pins 30 are provided that extend laterally outwardly from opposite sides of the actuator member into corresponding guide grooves 32 contained in the opposed side walls of the housing chamber 28. The operating member 26 contains groove 40 for receiving the knife edges 16 when the actuator member is in the fully engaged position of FIG. 1*e*.

Figure 4:
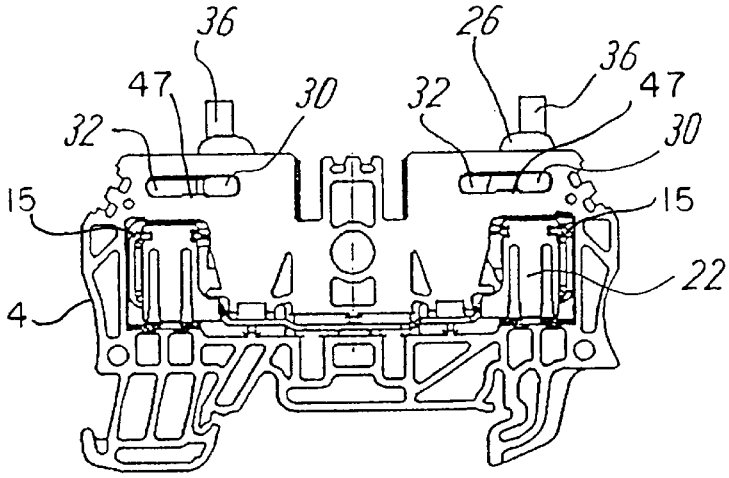
FIGS. 4 and 5 are side elevation and exploded views, respectively, of the terminal block assembly of FIG. 1.
Figure 5:
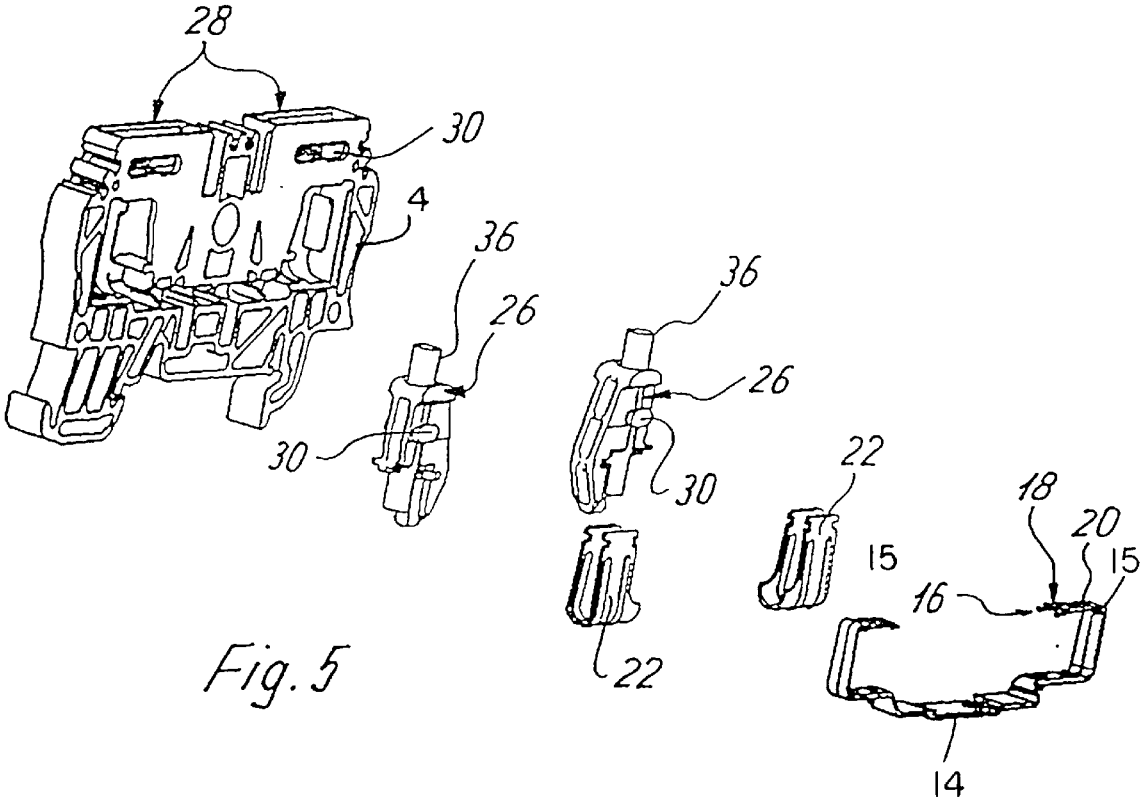

As shown in FIGS. 4 and 5, a pair of the actuator members 26 are provided at opposite ends of the terminal block housing 4, and a pair of the support springs 22 support the stationary resilient contacts 15 within the terminal block housing 4, respectively. The guide slots 32 are provided intermediate their ends with raised tapered portions 47 that cooperate with the guide pins to retain the actuator members in one of their engaged or disengaged positions.

Referring now to FIGS. 5, the support contacts 15 are carried by reversely inwardly bent end portions of the bus bar, whereby the knife edges 16 of the stationary resilient contacts 15 are directed toward each other. The stationary resilient contacts 15 are bifurcated by a longitudinally extending slit 18 that extends within the contact portion 20 of the stationary contact. The lateral sides of the contact portion 20 of the stationary contacts 15 contain recesses for receiving the upper extremities of the leg portions of the support springs 22.

Figures 6A, 6B, 6C:
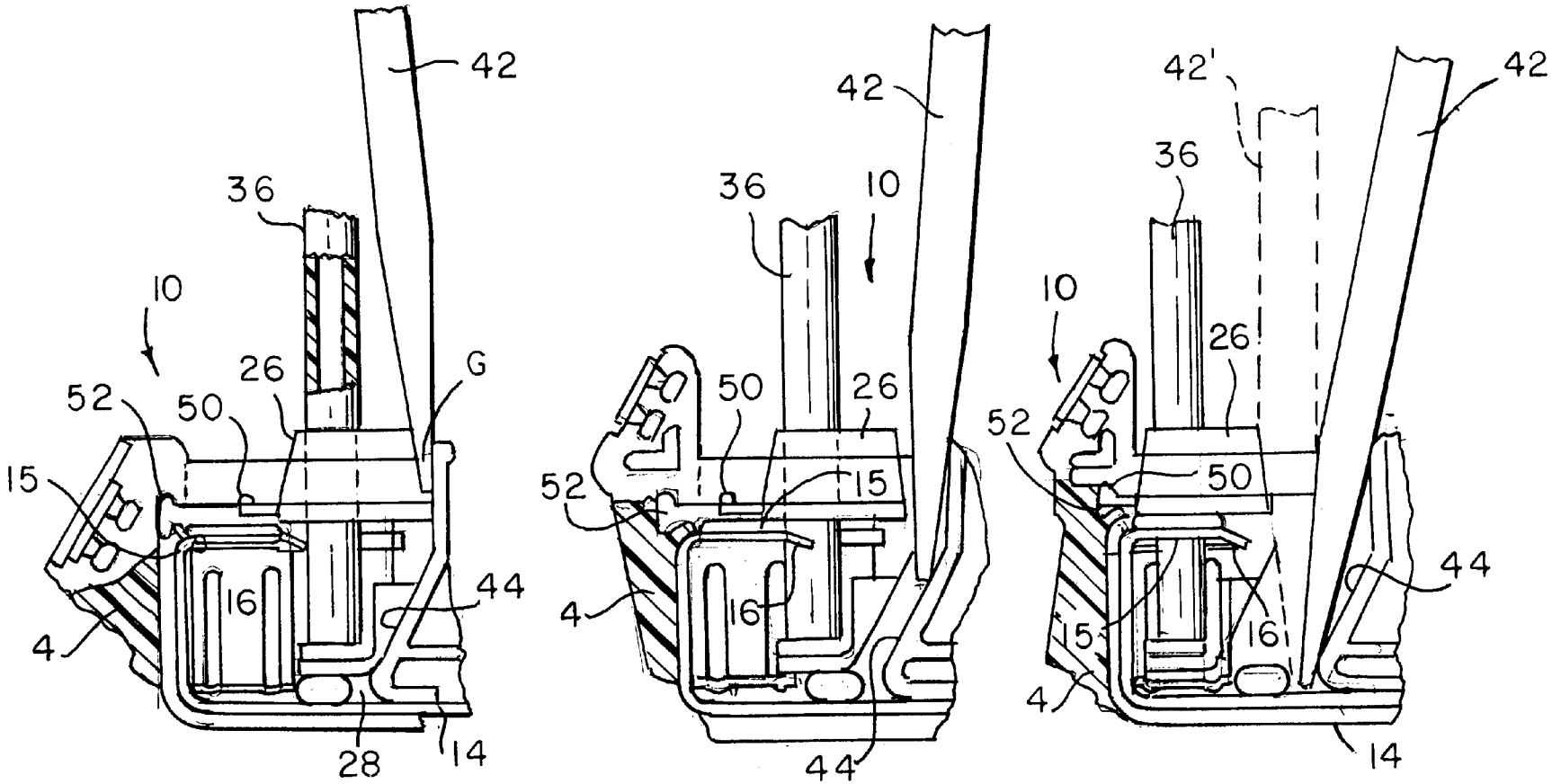
FIGS. 6*a*–6*c* are detailed views illustrating the displacement of the actuator member by the operating tool from the disengaged position to the engaged position.

Referring now to FIGS. 6*a*–6*c*, when the actuator member 26 is in the disengaged position of FIG. 6*a*, the insulated conductor is inserted downwardly within the vertical bore contained within the actuator 26, whereupon an operating tool 42, such as the tip of a screwdriver, is inserted in the gap G between the right hand end of the actuator member and the adjacent end wall of chamber 28. As the tool is progressively inserted downwardly into the chamber, the tip of the tool engages the downwardly inclined wall surface 44 to progressively displace actuator member 26 linearly to the left until the conductor 36 is brought into engagement with the knife edges 16 of the stationary contact 15. These knife edges penetrate the layers of insulation and come into contact with the electrical conductor. As the tool 42 is further inserted into the chamber 28, the tip of the tool eventually engages the bus bar 14 and the actuator member 26 is in the fully-engaged position of FIG. 6*c*. At this time, a locking extension 50 carried by the actuator member 26 extends into the locking recess 52 container in the adjacent end wall surface of the chamber 28, thereby to lock the actuator member in the engaged position.

Figure 7B:
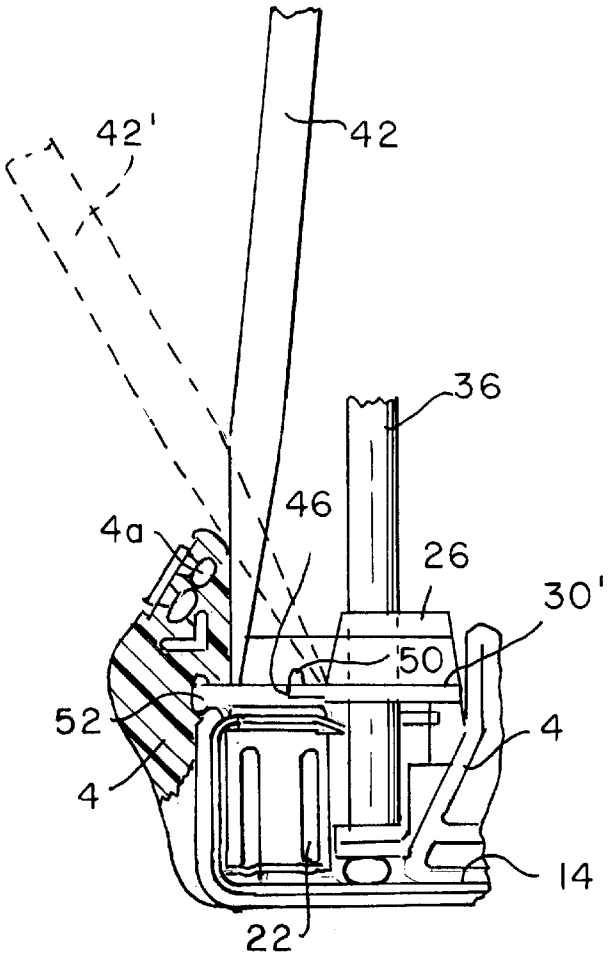
FIGS. 7*a* and 7*b* are detailed views illustrating the displacement of the actuator member by the operating tool from the engaged position to the disengaged position.
Figure 7A:
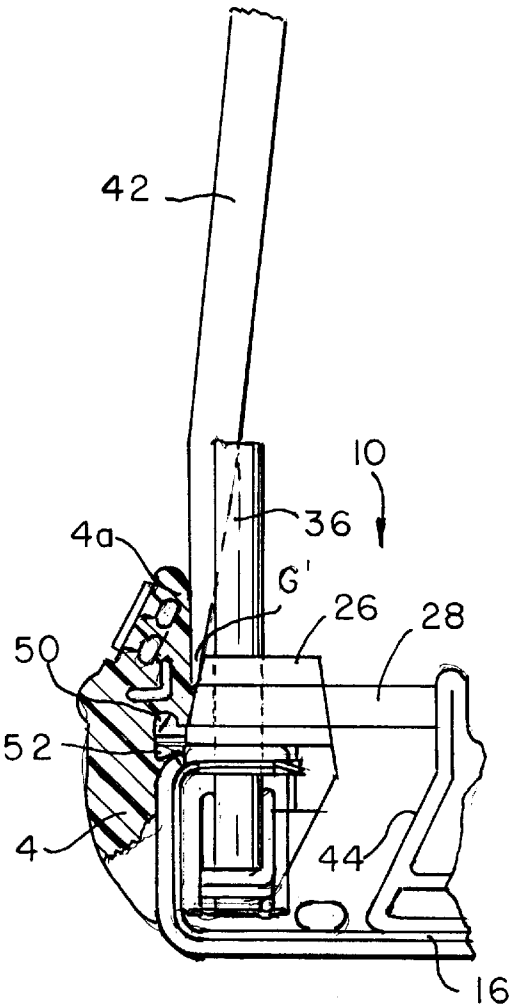

As shown in FIG. 7*a*, in order to displace the actuator member 26 linearly to the right toward the disengaged position, the tip of the tool 42 is introduced into the gap G' between the left of the actuator member and the adjacent end wall of chamber 28. The tool 42 is pivoted to the left about the fulcrum defined by housing portion 4*a*, locking projection 50 is disengaged from locking recess 52, and actuator member 26 and conductor 36 are displaced to the right toward the fully disengaged position of FIG. 7*b*.

Figures 8A, 8B, 8C:
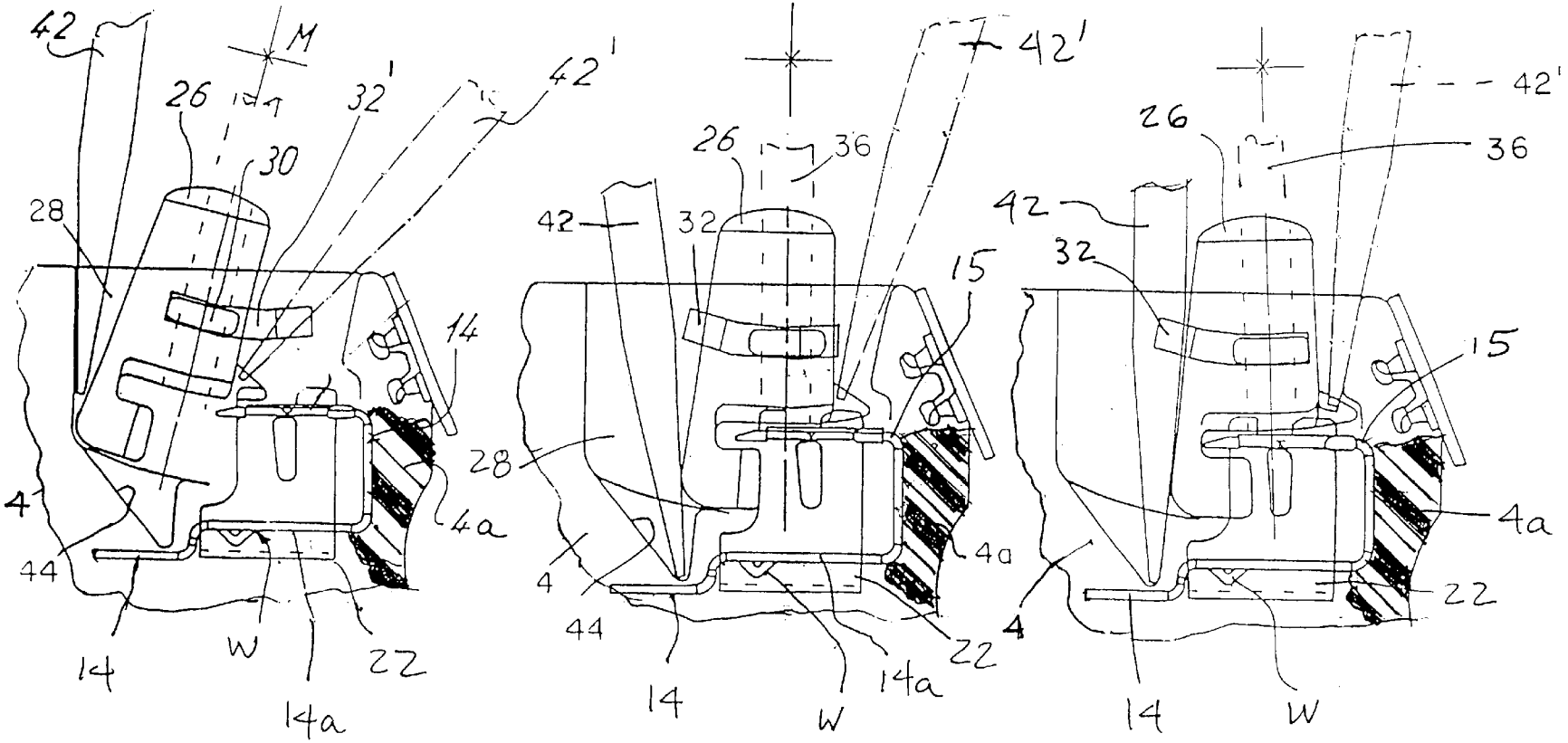
FIGS. 8*a*–8*c* are detailed views illustrating the pivotal displacement of the actuator member of another embodiment of the invention by the operating tool from the disengaged position to the engaged position.

As shown in FIGS. 8*a*–8*c*, the guide grooves 32' may be bent or curved for guiding the actuator member for pivotal movement along a curved path relative to the terminal block housing 4. In this embodiment, the portion 14*a* of the bus bar is supported by the abutment W carried by the support spring 22 through which the bus bar extends. As the tip of the operating tool 42 is progressively introduced into chamber 28 and the tip of the tool engages the downwardly inclined surface 44, the actuator member is pivoted to the right toward the fully engaged position of FIG. 8*c*. As shown in phantom, to pivotally displace the actuator member 26 toward the disengaged position, the operating tool is introduced into chamber 28 on the right side of the actuator member 26, and the tool is pivoted in the clockwise direction about the fulcrum defined by the mouth portion of the opening, whereupon the actuator member is pivoted toward the disengaged position of FIG. 8*a*.

Figure 9:
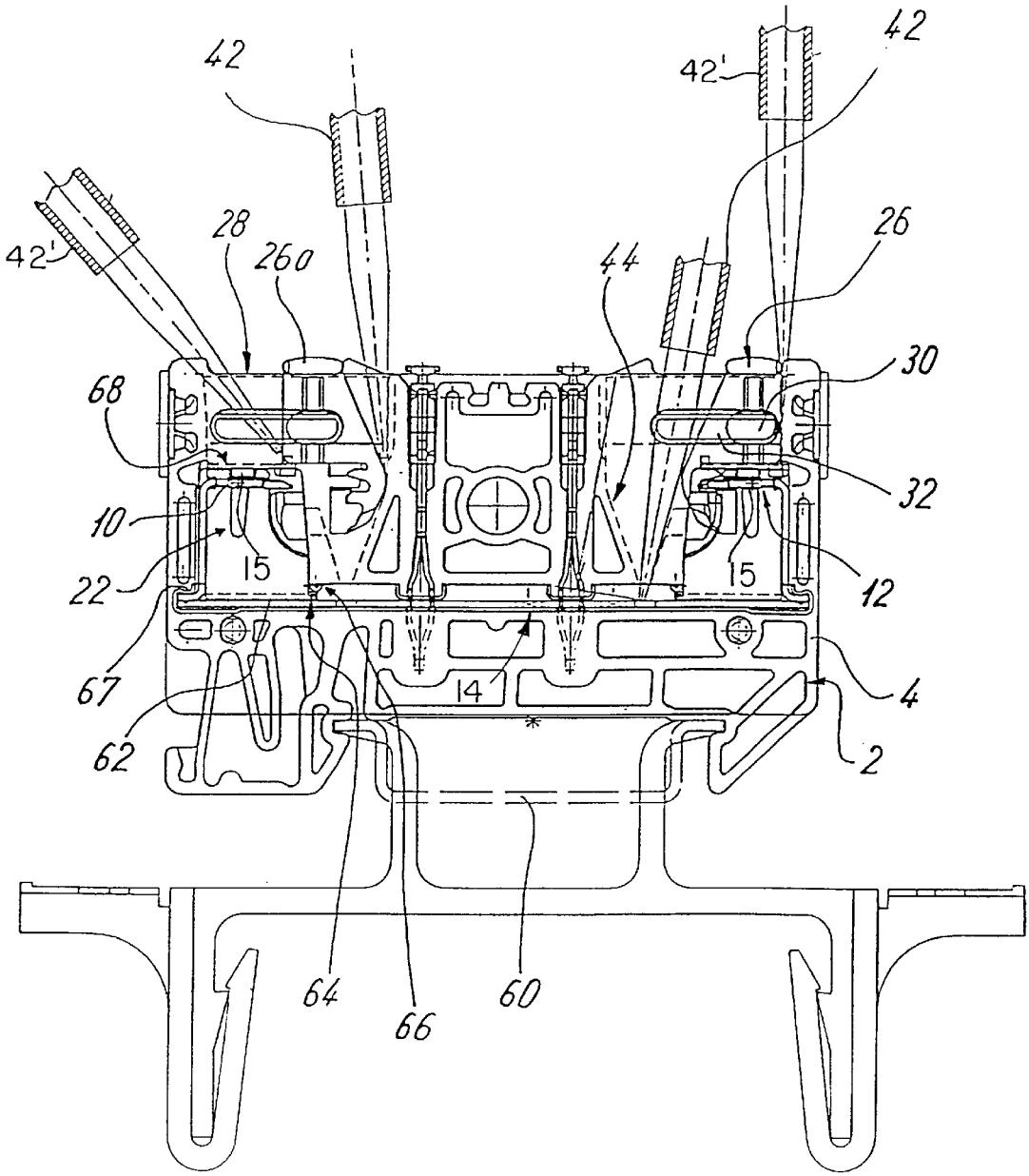
FIG. 9 is an elevational view illustrating the operation of a further embodiment of the terminal block assembly of the present invention.
Figure 10:
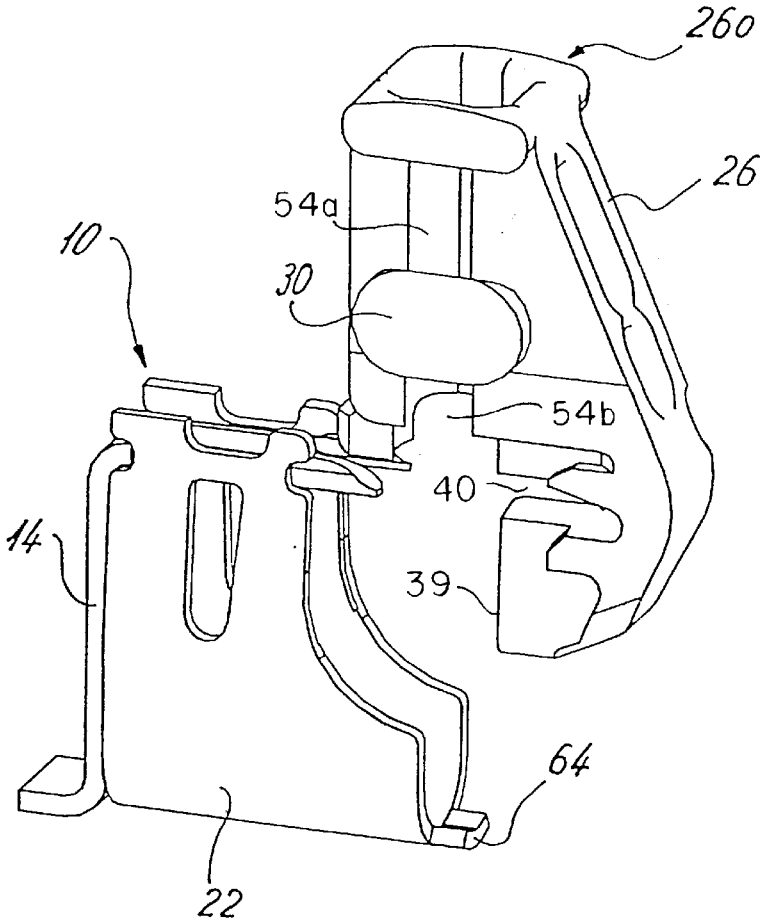
FIG. 10 is an exploded view of the support spring and actuator member.

Referring to the modification of FIG. 9, the bus bar 14 includes a linear first portion 62 that extends between the support springs 22, and a pair of end sections 67 that are generally Z-shaped. To retain the support springs 22 in place, a protrusion 64 thereof (FIG. 10) extends between a corresponding abutment 66 carried by the terminal block housing, as shown in FIG. 9. The mounting feet portion of the terminal block are connected with outwardly directed flanges of the U-shaped mounting rail 60, as is known in the art. In accordance with an important feature of the invention, the housing includes a protective edge portion 68 that extends in spaced relation above the stationary contact 15, thereby to prevent the engagement of the contact by the tip of the operating tool 42.

Figure 11:
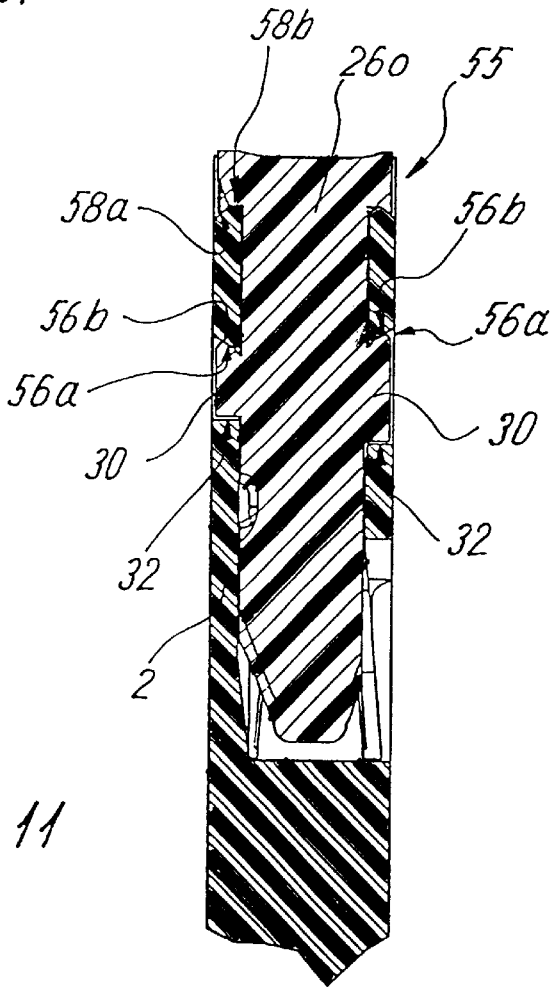
FIG. 11 is a sectional view illustrating the dovetail guide means of another embodiment of the invention.

As shown in FIG. 11, the guide means may be of the dovetail tongue and groove type, wherein the beveled edges 56*b* of the guide pins 30 engage corresponding beveled edges 56*a* in the guide slots 32. Similarly, an upper dovetail connector may be provided by the beveled surfaces 58*a* and 58*b* in the grooves defined in the actuator body above the guide pins.

Figure 12:
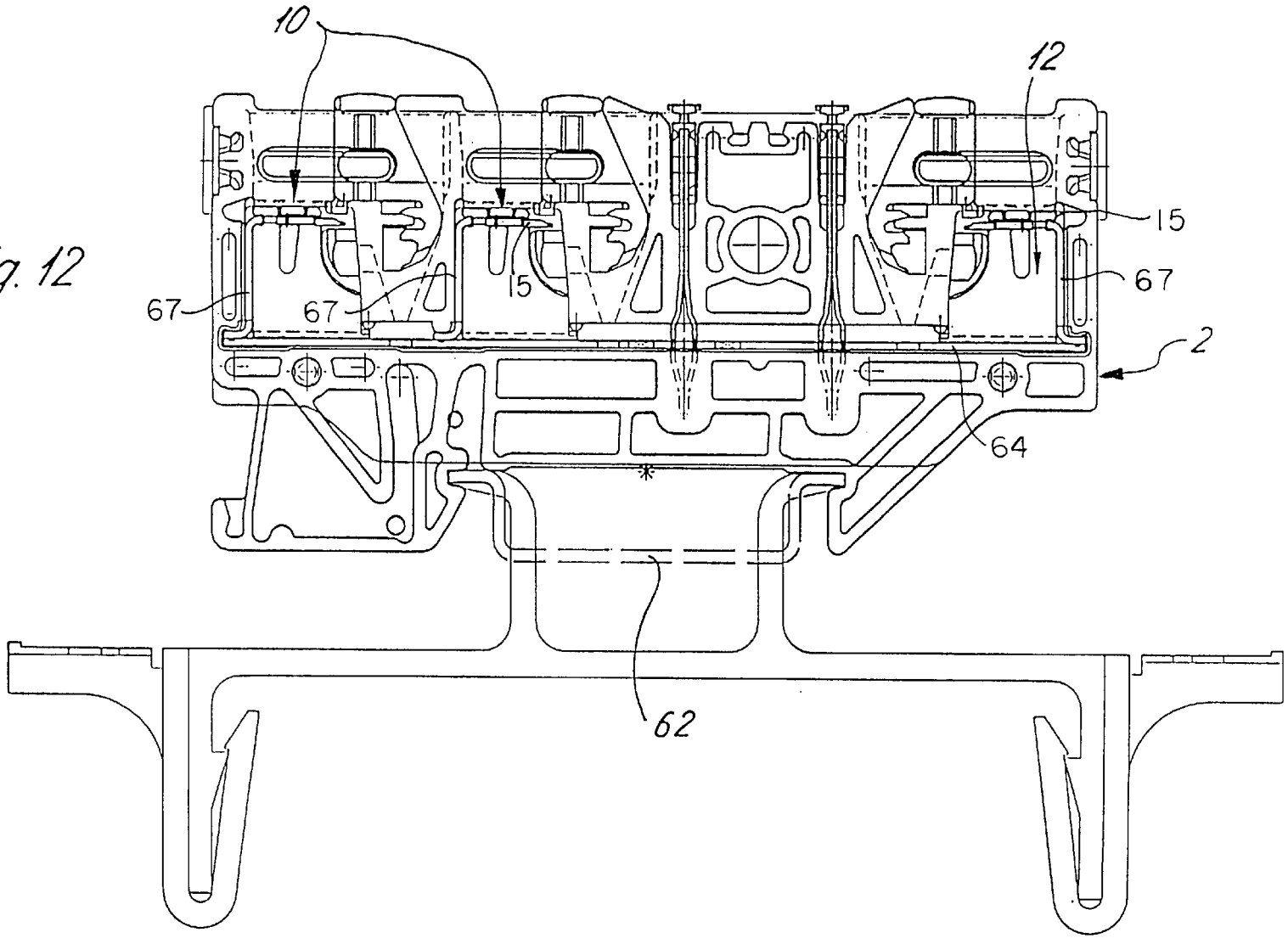
FIG. 12 is a side elevation view of another terminal block assembly embodiment according to the present invention.

Referring to FIG. 12, it will be seen that by the use of the Z-shaped bus bar sections 67, various numbers of stationary contacts 15 may be supported in spaced relation along the linear bus bar section 64.

While in accordance with the provisions of the Patent Statutes the preferred forms and embodiments of the invention have been illustrated and described, it will be apparent to those skilled in the art that various changes may be made without deviating from the inventive concepts set forth above.

What is claimed is:

1. A terminal block assembly for connecting an insulated electrical conductor (36) with a stationary electrical contact (15), comprising:

(a) a hollow rectangular horizontally arranged terminal block (2) having a housing (4) formed of synthetic plastic insulating material, said terminal block housing containing at least two longitudinally spaced chambers (28) each having opposed end walls;

(b) a bus bar (14, 78, 96) mounted within said terminal block and including longitudinal portions extending within said chambers respectively;

(c) a pair of horizontal resilient electrical contacts (15) supported by said bus bar within remote ends of said chambers, respectively, said contacts being directed inwardly toward each other, each contact having a bifurcated end portion provided with a pair of knife edges (16) separated by a slit (18) that extends within a conductor contact portion (20) of said contact;

(d) a pair of actuator members (26) arranged within said chambers for displacement between engaged and disengaged positions relative to the associated stationary contacts, respectively, each of said actuator members containing a vertical bore (34) for receiving an end portion of an insulated conductor when said actuator member is in said disengaged position, and (e) guide means guiding each of said actuator members for movement between said engaged and said disengaged positions, respectively, said guide means including;

(1) a pair of guide pins (30) extending laterally from opposite sides of said actuator member;

(2) said housing chamber having opposed side walls that contain opposed guide grooves (32) that receive said guide pins, respectively;

(f) said actuator members extending upwardly in their respective chambers beyond said housing and cooperating with associated first chamber end walls to define first gaps (G) when said actuators are in their engaged positions, respectively, whereby the tip of an operating tool may be introduced into one of said first gaps to displace the associated actuator from the disengaged position toward the engaged position.

2. A terminal block assembly as defined in claim 1, wherein said guide grooves are straight, thereby to guide said actuator members for linear displacement relative to said terminal block housing.

3. A terminal block assembly as defined in claim 1, wherein said guide grooves are curved, thereby to guide said actuator members for pivotal movement relative to said terminal block housing.

4. A terminal block assembly as defined in claim 1, wherein said guide pins have a circular cross-sectional configuration.

5. A terminal block assembly as defined in claim 1, wherein said guide pins have a non-circular cross-sectional configuration.

6. A terminal block assembly as defined in claim 1, wherein each of said guide grooves contains a pair of longitudinally spaced end walls, an intermediate portion of each of said grooves between said groove end walls containing a vertically extending centrally-located tapered projection (47), thereby to restrict displacement of said actuator member between said engaged and disengaged positions.

7. A terminal block assembly as defined in claim 1, wherein said associated chamber end wall that is adjacent said actuator member when said actuator member is in the disengaged position includes a downwardly and inwardly directed inclined support surface (44), thereby to support the tip of said operating tool during the displacement of said actuator member toward said engaged position.

8. A terminal block assembly as defined in claim 7, wherein said bus bar extends within the bottom of said terminal block housing chamber below said inclined support surface.

9. A terminal block assembly as defined in claim 7, and further including a locking projection (50) that extends horizontally from each of said actuator members into a corresponding locking recess (52) contained in an opposite second housing chamber end wall, thereby to lock said actuator in said engaged position.

10. A terminal block assembly as defined in claim 9, wherein said actuator member cooperates with said second housing chamber end wall to define a second gap (G') when said actuator member is in said engaged position; and further including means defining a stop (46) on said locking projection against which the tip of said operating tool abuts, thereby to unlock said locking projection and support the tool during the displacement of said actuator member toward said disengaged position.

11. A terminal block assembly for connecting an insulated electrical conductor (36) with a stationary electrical contact (15), comprising:

(a) a hollow rectangular horizontally arranged terminal block (2) having a housing (4) formed of synthetic plastic insulating material, said terminal block housing containing at least two longitudinally spaced chambers (28) each having opposed end walls;

(b) a bus bar (14, 78, 96) mounted within said terminal block and including longitudinal portions extending within said chambers respectively;

(c) a pair of horizontal resilient electrical contacts (15) supported by said bus bar within remote ends of said chambers, respectively, said contacts being directed inwardly toward each other, each contact having a bifurcated end portion provided with a pair of knife edges (16) separated by a slit (18) that extends within a conductor contact portion (20) of said stationary contact;

(d) a pair of actuator members (26) arranged within said chambers for displacement between engaged and disengaged positions relative to the associated stationary contacts, respectively, each of said actuator members comprising:

(1) an actuator body having an upper portion containing a vertical through bore (34) for receiving an end portion of an insulated conductor (36) when said actuator member is in said disengaged position;

(2) said actuator body having a lower portion including a vertical support wall (39) arranged to laterally support the insulated conductor opposite the associated stationary contact, said support wall containing a horizontal recess (40) opposite said stationary contact, thereby to receive said contact when said actuator member is in said engaged position;

(3) said actuator members extending upwardly in their respective chambers beyond said housing and cooperating with said chamber end walls to define first gaps (G, G') when said actuators are in their disengaged and engaged positions, respectively, whereby the tip of an operating tool may be introduced into one of said gaps to displace the associated actuator from the one position to the other; and (e) guide means guiding said actuator member for movement between said engaged and said disengaged positions, respectively, each of said guide means including;

(1) a pair of guide pins (30) extending laterally from opposite sides of said actuator member upper body portion;

(2) said housing chamber having opposed walls that contain opposed guide grooves (32) that receive said guide pairs, respectively.

12. A terminal block assembly as defined in claim 11, wherein said actuator body upper portion contains opposed pairs of vertically spaced transverse openings **(54*a*, 54*b*)** communicating with said bore, thereby to receive the insulating layer of an inserted conductor.

13. A terminal block assembly as defined in claim 11, wherein said guide pin and guide groove comprise a dovetail tongue and groove connection.

14. A terminal block assembly as defined in claim 13, wherein said guide pin and said guide groove have cooperating beveled surfaces **(56*a*, 56*b*; 58*a*, 58*b*)**, respectively.

* * * * *